US006676112B2

(12) United States Patent
Dorr

(10) Patent No.: US 6,676,112 B2
(45) Date of Patent: Jan. 13, 2004

(54) WINCH LINE SAFETY DEVICE AND METHOD THEREFOR

(76) Inventor: Bryan D. Dorr, 560 E. 12th St., Rifle, CO (US) 81650-3612

( * ) Notice: Subject to any disclaimer, the term of this patent is extended or adjusted under 35 U.S.C. 154(b) by 0 days.

(21) Appl. No.: 10/260,859

(22) Filed: Sep. 30, 2002

(65) Prior Publication Data

US 2003/0080327 A1 May 1, 2003

Related U.S. Application Data

(60) Provisional application No. 60/335,525, filed on Oct. 31, 2001.

(51) Int. Cl.[7] ..... B66D 1/00
(52) U.S. Cl. ..... 254/323
(58) Field of Search ..... 254/323; 43/19, 43/42.39, 42.49

(56) References Cited

U.S. PATENT DOCUMENTS 413,389 A * 10/1889 Cruikshank ..... 105/149
2,250,595 A * 7/1941 Messman ..... 408/133
3,638,347 A * 2/1972 Kochevar ..... 43/42.39
4,392,680 A * 7/1983 Wolfe ..... 294/82.11
5,926,996 A * 7/1999 Frazier ..... 43/43.1
5,975,498 A * 11/1999 Sauner ..... 254/323
6,299,403 B1 * 10/2001 Lee ..... 414/463

OTHER PUBLICATIONS

Warn Industries, The Basic Guide to Winching Techniques, Warn Industries Off Road Products, 2001, pgs. 1–15, USA.

* cited by examiner

*Primary Examiner*—Emmanuel Marcelo
(74) *Attorney, Agent, or Firm*—Dorr, Carson, Sloan, Birney & Kramer, P.C.

(57) ABSTRACT

A safety device for a winch for minimizing line whipping when the line improperly releases. A weight is coupled to the line at a selected region on the line when the line is extended from the winch to winch an object. When the extended line suddenly releases the weight provides a weighted pivot for the released cable. The safety method provides coupling a weight to the line and, locking the weight at a selected region of the line when the line is extended from the winch for winching. When the extended line suddenly releases the locked weight provides a weighted pivot for the released cable.

15 Claims, 6 Drawing Sheets

10
20
420
4b
4b
20
410
30
50

110
40
50
60
C
10
20
30
21
100
80
82
70

Fig. 7A
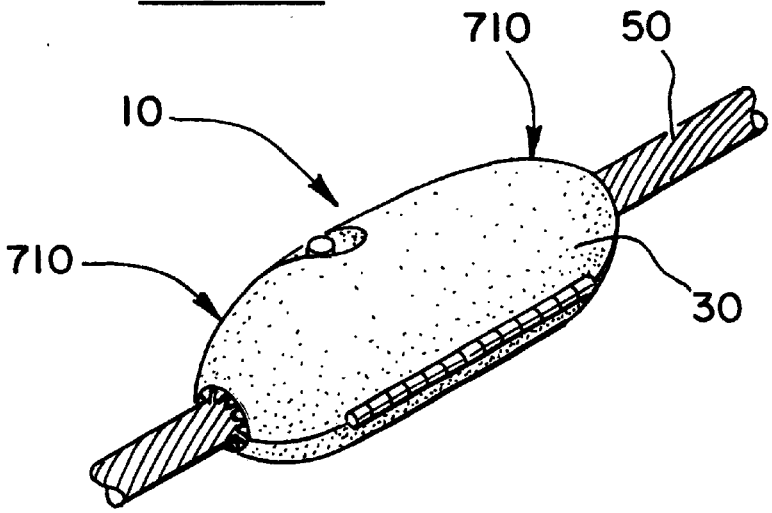
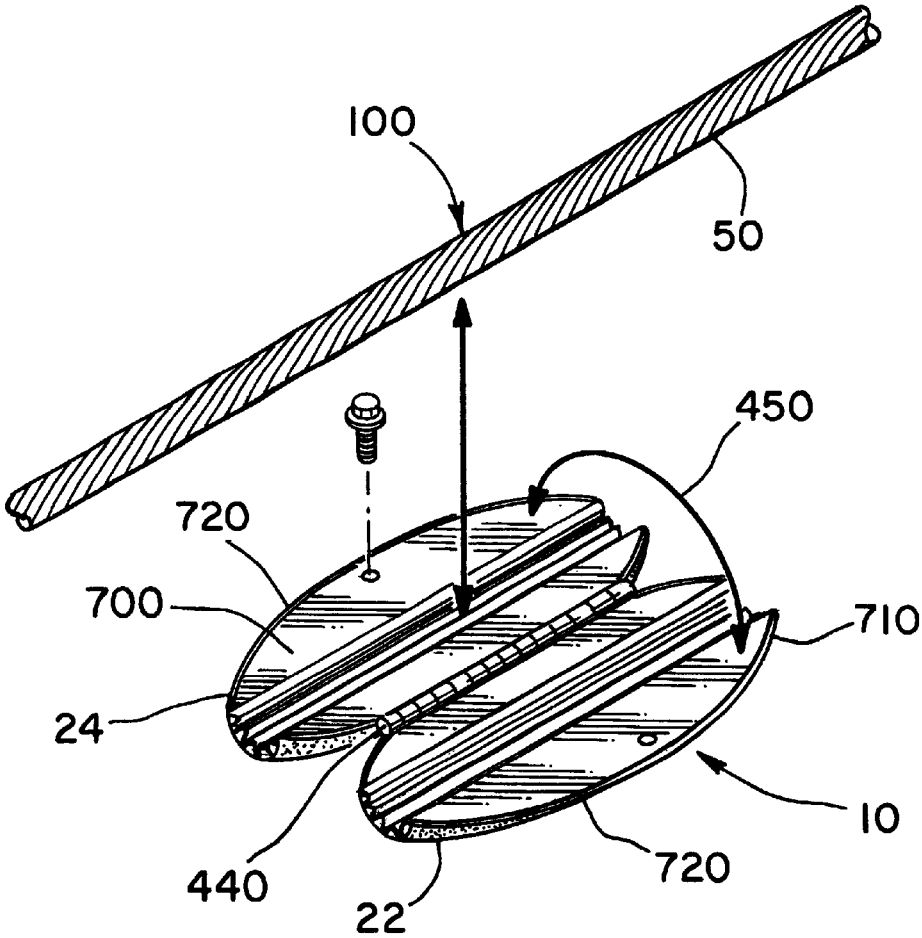
Fig. 7B

WINCH LINE SAFETY DEVICE AND METHOD THEREFOR

RELATED APPLICATIONS

This application claims the benefit of U.S. Provisional Patent Application Ser. No. 60/335,525 filed Oct. 31, 2001.

BACKGROUND OF THE INVENTION

1. Field of the Invention

The present invention relates to a winch line safety device and method and, more particularly, to a device and method for minimizing line whipping upon line breaking or other improper line release.

2. Discussion of the Background

Off-road four-wheeling has become a major sporting and recreational past time. Most 4×4 vehicles also carry a winch which can be used for a variety of purposes. Rarely, when the line in the winch is in use and under severe tension it suddenly releases which may cause the released end of the line to whip. The sudden release may be due to the line breaking or, for example, the object hooked to may break. The whipping end of the line may cause damage to the vehicle carrying the winch such as breaking a windshield or damaging the body of the vehicle.

It is known to raise the hood of the vehicle to stop the free end of the line when whipping so as to prevent windshield damage.

It is also known to throw an item such as a jacket, a blanket or floor mats over the line in use so that in the event the line releases and whips, the item aids to reduce line whipping through a parachute action. For example, Warn Industries recommends using a heavy quilted mover's blanket located midway between the winch and the anchor point to absorb the energy should the line break ("The Basic Guide to Winching Techniques," 2001, www.warn.com).

A need exists for a safety device and method for reducing/minimizing line whipping when a line winch is under tension and then suddenly releases.

SUMMARY OF THE INVENTION

The safety device of the present invention is used to prevent a winch line from whipping when the line improperly releases. A weight is coupled to the line at a selected region on the line when the line is extended from the winch to an object. When the extended line suddenly releases the weight provides a weighted pivot for the released line.

A safety method of the present invention provides coupling a weight to the line and locking the weight at a selected region of the line when the line is extended from the winch for winching to an object. When the extended line suddenly releases the locked weight provides a pivot for the released line.

BRIEF DESCRIPTION OF THE DRAWINGS

FIGS. 7A and 7B illustrate a third embodiment of the winch line safety device of the present invention.

DETAILED DESCRIPTION OF THE INVENTION

1. Overview.

Figures 1, 3:
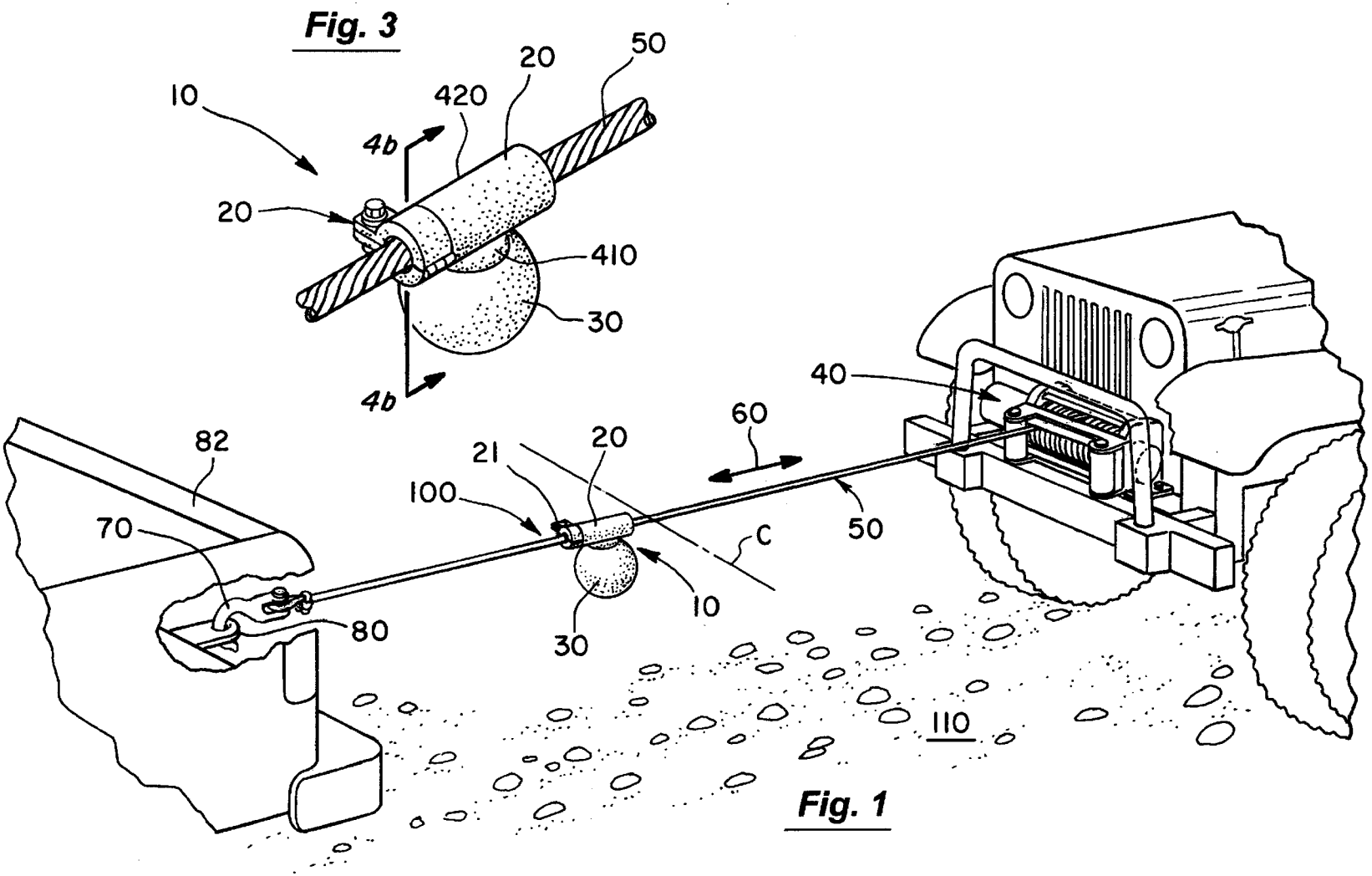
FIG. 1 is an illustration showing a winch with its line extended out from the winch and the safety device of the present invention coupled to the line.
FIG. 3 is a perspective view of one embodiment of the winch line safety device of the present invention.

The safety device 10 of the present invention, as shown in FIG. 1, includes a coupler 20 and a weight 30. In FIG. 1, the winch 40 has a line 50 under tension, as shown by arrow 60, when the hook end 70 of the line 50 is hooked to an anchor point 80. The anchor point 80 can be another vehicle 82, a tree, etc. Whatever the anchor point 80 is, does not limit the teachings of the present invention. In the following the term "winch line" is used to discuss the invention set forth in the drawings. The term "winch line" shall mean wire rope, metal cable, nylon strap, nylon line, or any other lines manufactured of material to meet winching load requirements.

The safety device 10 of the present invention engages by locking to the line at a region 100 on the line 50 which is selected by a user of the present invention. In FIG. 1, C is the approximate centerline between the anchor point 80 and the winch 40. Typically, the user selects region 100 near or at the centerline C, but the present invention is not limited to use at this location. The user locates and locks the safety device 10 before the line 50 is put under tension.

Figure 2:
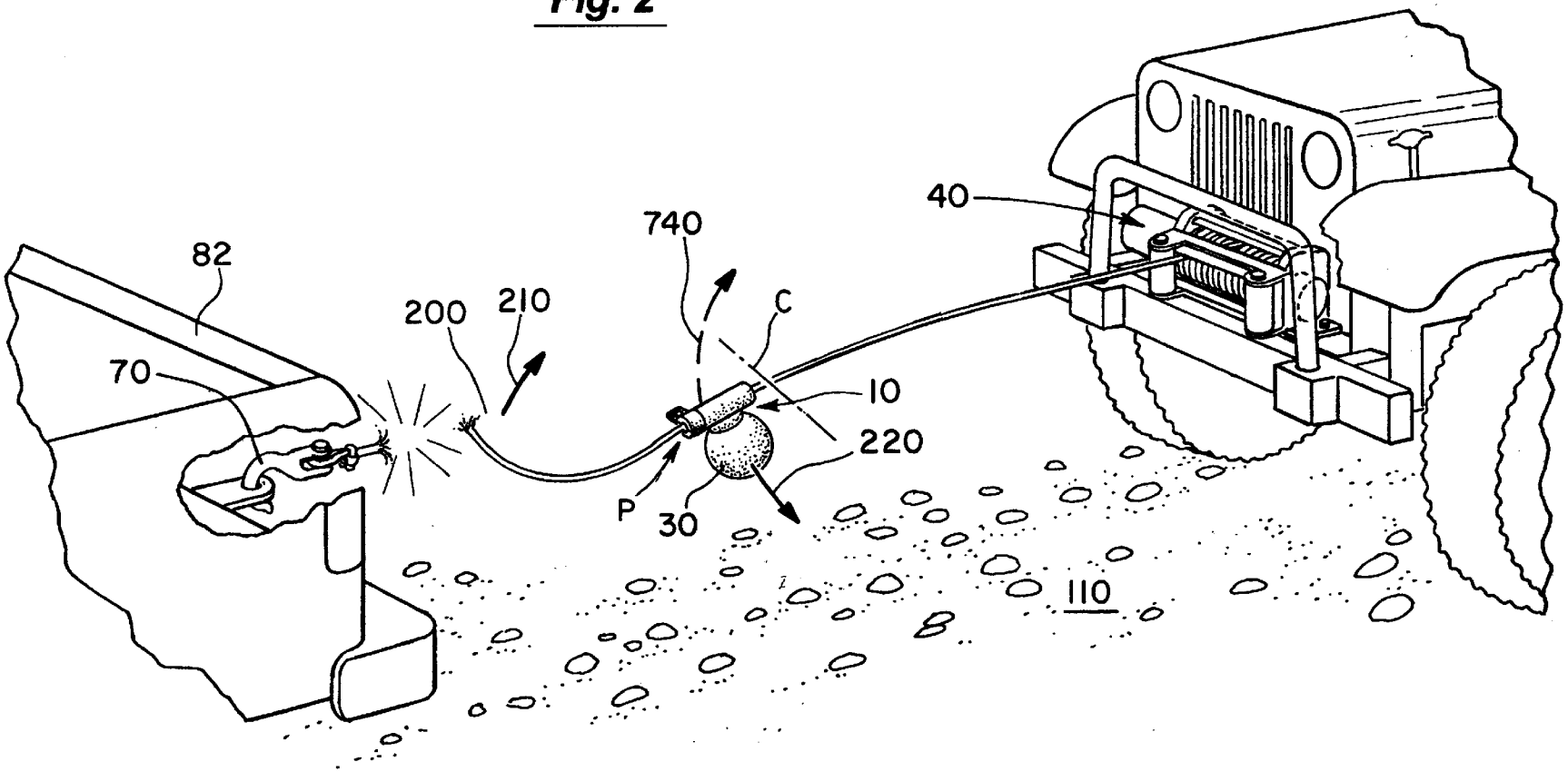
FIG. 2 is the illustration of FIG. 1 in which the extended line suddenly releases with the safety device of the present invention providing a weighted pivot for the released line.

As shown in FIG. 2, when the line 50 suddenly releases (such as through breakage of the wire rope 50 or a portion of the anchor point 80 or object 82 breaking off, etc.), the free end 200 of the line 50 whips backwardly 210 usually towards the winch 40. The weight 30 of the present invention seeks to drop in the direction of arrow 220. The dropping of the weight 30 also tends to cause a pivot P near the weight 30 on the line 50. The dropping of the weight 30 and the creation of the pivot P tend to restrict how far back the free end 200 can whip 210. What causes the breakage (or release) of line 50 is immaterial to the teachings of the present invention.

Figure 4A:
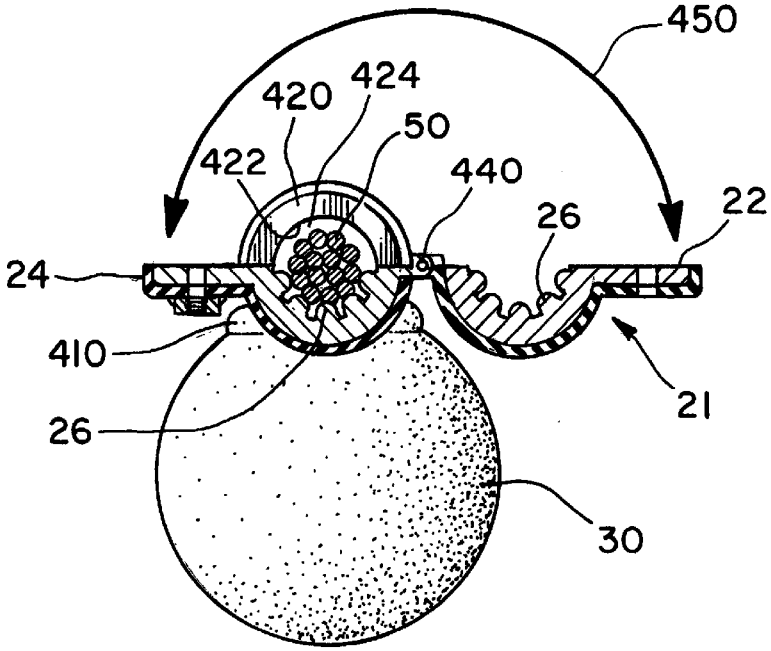
FIGS. 4A and 4B are planar views, with a partial cross section, showing the locking of the weight of the present invention to the line in a selected region on the line.
Figure 4B:
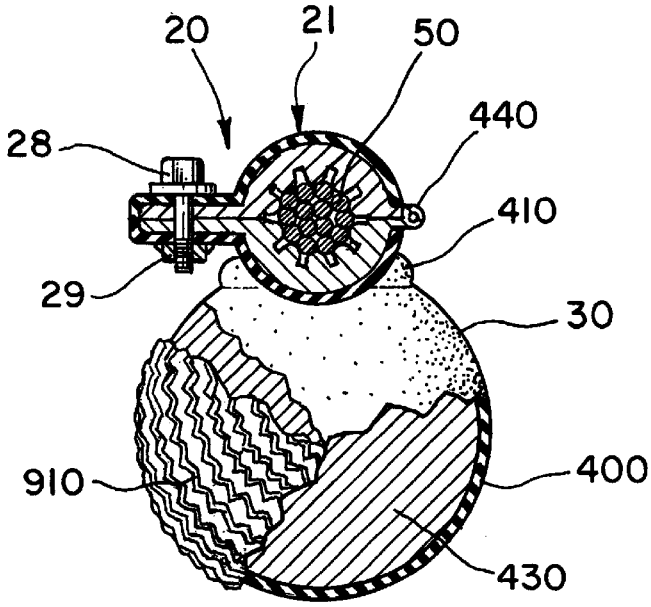
Figure 5:
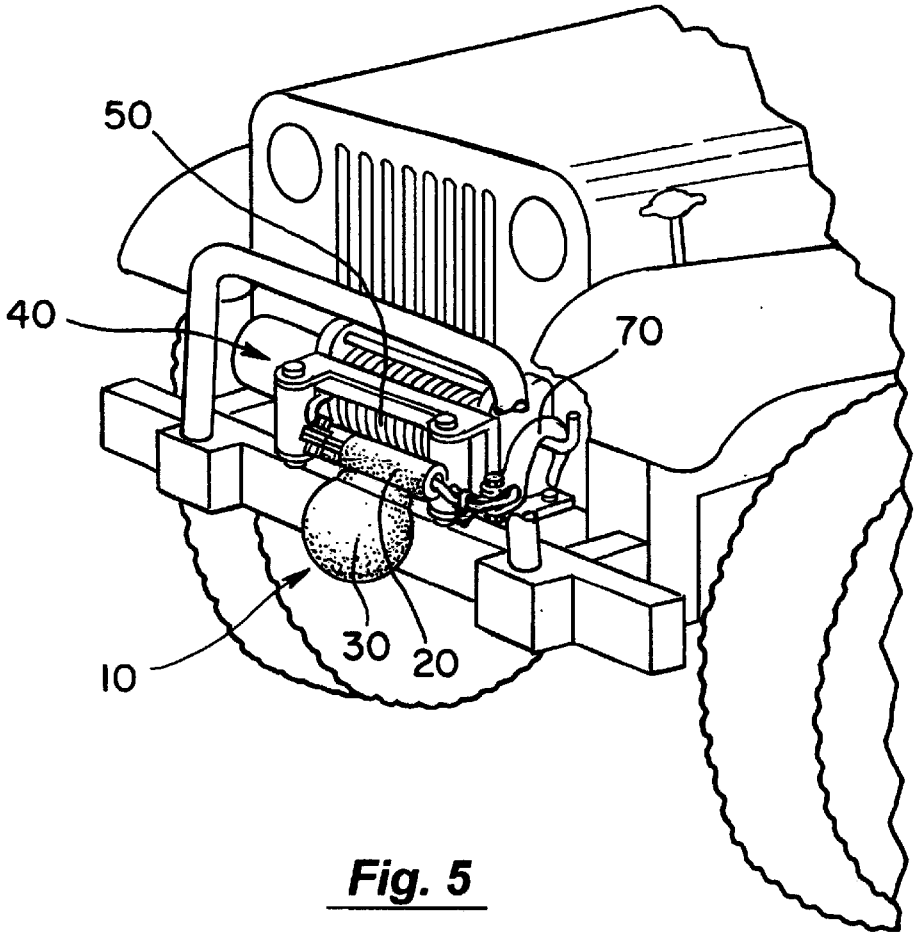
FIG. 5 is the winch of FIG. 1 with the line fully retracted into the winch and the safety device of the present invention held at the hook end of the line.
Figure 6:
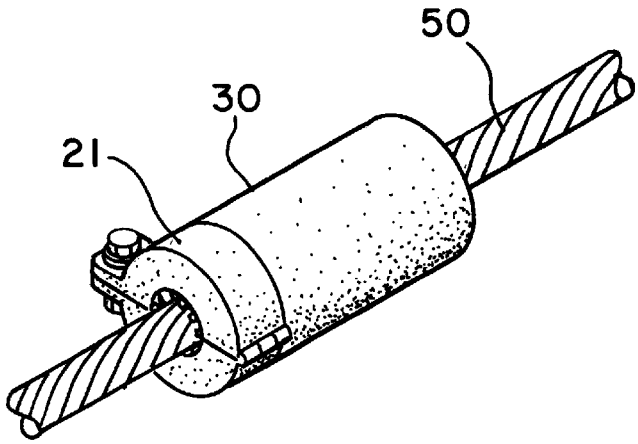
FIG. 6 is a perspective view of a second embodiment of the winch line safety device of the present invention.

In one embodiment of the present invention, as shown in FIGS. 1–6, the safety device 10 is always coupled to the line 50. In this embodiment, the safety device 10 is at the hook end 70 when the line 50 is fully retracted in the winch 40 as shown in FIG. 5. When the line 50 is extended-from the winch 40, the safety device 10 slides along the line 50 to the selected region 100 by the user wherein the user locks the safety device 10 to the line 50.

In another embodiment, as shown in FIGS. 7A and 7B, the safety device 10 is releasable from the line 50 when the weight is not in use. When the line 50 is hooked to the anchor point 80, the user locks the safety device 10 to the line 50 at the selected region 100. This embodiment while functioning as in the first embodiment to provide a pivot P, provides an aesthetic advantage when the user does not want the safety device 10 affixed to the line 50 when driving about and not using the winch 40. The safety device 10 can be stored elsewhere in the vehicle.

In one variation of the present invention, the safety device 10 is brightly colored, as a solid color, as a pattern, or having graphics to remind the user to use the safety device 10 on the line 10 at a selected region 100. The safety device 10 of the present invention can be manufactured in a number of embodiments, such as, but not limited to those presented next. The safety device 10 of the present invention, unlike the use of a conventional blanket, is coupled to the line 50 and provides a weighted pivot P. Any weighted safety device 10 performing this function and method, other than those discussed next, fall within the scope of the present invention.

2. Weight 30.

In FIGS. 3, 4A and 4B, one embodiment of the safety device 10 of the present invention has a downwardly extending weight 30. The weight 30 is shown as a ball 30. Weight 30, however, can be any shape, spherical, triangular, teardrop, square, rectangular, trapezoidal, etc. The weight can be made from one material or of a composite of more than one material. The weight 30 can be made of metal or a softer, rubber-like (or plastic) material.

As shown in FIG. 4B, the weight 30 can optionally be coated 400 with a suitable coating such as a rubber-like or durable foam or any other suitable "soft" coating material that can withstand the severe environmental elements of outdoor use. The weight, in another variation, can have preformed raised shapes 410 on its outer surface such as outwardly extending shallow cylinders, cups, ridges, etc. to provide for shock absorption when the weight hits an object. Any suitable shock-absorbing material can be used such as rubberized and/or foam materials. In one variation of the present invention, the weight 30 is spherical (or teardrop) in shape with a colored or a brightly colored (e.g. yellow), durable rubberized (or plasticized) coating 400. In other variations, the coating 400 can be a harder coating, and in some variations, the coating 400 is not used. The coating 400 in one variation covers the coupler 430, the connection 410, and the weight 30.

Figure 8:
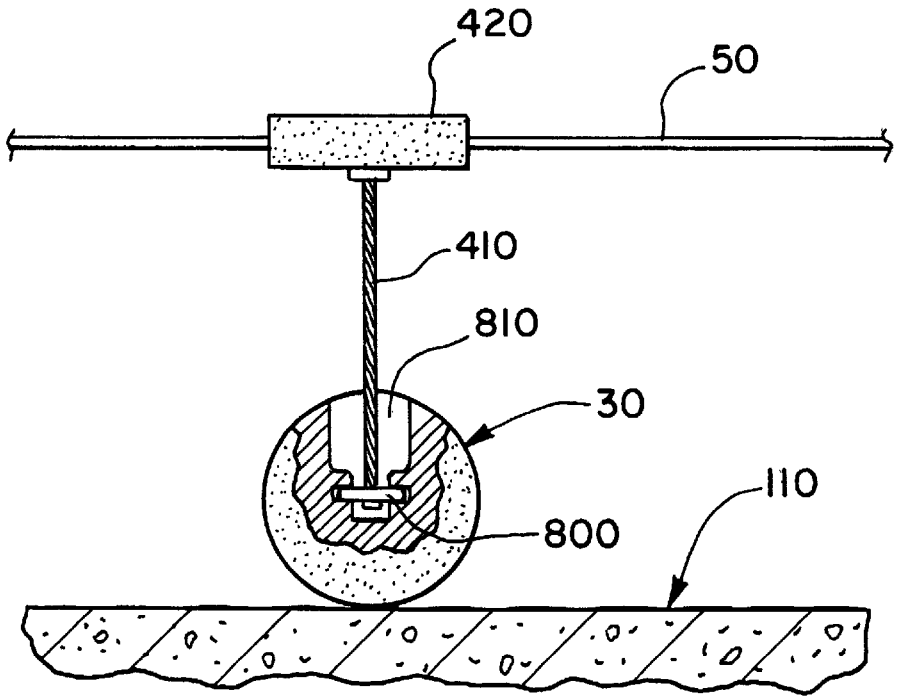
FIG. 8 is a fourth embodiment of the winch of the present invention.

In FIGS. 3, 4A, and 4B, the weight 30 in one embodiment is connected 410 to a coupler 420. Coupler 20 has two components: top 420 and connector 410. The coupler top 420 is preferably a sleeve or cylinder of strong material which goes over the line 50. The inside surface 422 of the coupler top 420 can be spaced 424 from the line 50 or slightly abutting it, not shown. The spacing 424 allows the user to easily slide the safety device 10 over the line 50. Again, the coupler top 420 can be any desired shape and the invention is not limited to the shape, length, or the composition of material used. In one variation, the coupler top 420 is metallic, such as iron or steel, welded 410 to connect to the iron or steel body 430 of the weight 30. In another variation, the coupler connection 410 is a rivet, screw, joint, pivot, or any other mechanical means for connecting the weight 30 to the coupler top 420. In another variation, the connector 410, as shown in FIG. 8, is a cable (or any other line) of sufficient length that connects the weight 30 to the coupler 420 so that the weight 30 rests on the surface 110 of the ground. In one variation, the cable 410 is connected 800 internally to the weight 30 so that the cable 410 can be stored in a hollow portion 810 of the weight 30. In another variation, not shown, the cable 410 can automatically retract, through use of a conventional spring mechanism, not shown into the cavity 810.

In the embodiment of FIGS. 7A and 7B, the weight 30 is an elongated cylinder disposed about the line 50. Again, any shape, such as a spherical size, could be used. The elongated cylinder as shown in FIG. 7B has the iron weight portion 700 coated with the coating material 710. In this embodiment the edges 710 are curved or rounded. This design of rounding the edges could also be utilized with respect to the embodiments of FIGS. 3, 4A, and 4B. The goal in using the curved edges 710 and 720 is to minimize any sharp edges. As shown in FIG. 2, it is possible for the weight 30 to move in the direction of dotted arrows 740 if the tension 60 (FIG. 1) is so great that it actually causes the weight 30 to be lifted up even though there is a tendency of the weight 30 to drop towards the ground. This results in a complex interaction of forces with the line 50 and the whipping end 200 in the direction of arrow 210, the tension 60 also causing the weight 30 to lift upwardly 740 with the force of gravity seeking to drop the weight 30 in the direction of arrow 220. The safety device 10 shown in FIGS. 7A and 7B of the present invention, having rounded edges and the use of a coating 710 minimizes such impact. The goal of the safety device 10 of the present invention is to minimize damage as it is difficult, if not impossible, to eliminate damage upon improper line 50 release as shown in FIG. 2.

3. Coupler 20 and Lock 21.

In FIGS. 4A and 4B, one embodiment of the coupler 20 the present invention is shown. The coupler 20 couples the weight 30 to the line 50. In FIGS. 4A and 4B the, coupler 20 has a lock 21 with half portions 22 and 24 and a gripping region 26 which grips the outer surface of line 50 as shown in FIG. 4B. Lock 21 uses a bolt 28 to engage a nut 29. The nut 29 is affixed to half portion 24. The bolt 28 is tightened into place so that the lock 21 firmly engages the outer surface of the line 50. The engagement of the outer surface is designed to firmly engage, but not damage the line 50. The half portion 24 of the lock 21 is an integral extension of the cylinder 420 so that when the bolt 28 is tightened into place, the safety device 10 of the present invention is locked to line 50 in region 100.

In FIGS. 7A and 7B, the weight 30 is contained in the coupler 20, however, the two half portions 22 and 24 of the lock pivot about the hinge 440. In this variation, the weight 30 releases from the line 50 and the safety device 10 of the present invention can be separately transported from the winch 40 so that it is not permanently mounted to the winch 40 (as shown in FIG. 5) for the embodiments of FIGS. 3, 4A and 4B.

Figure 9:
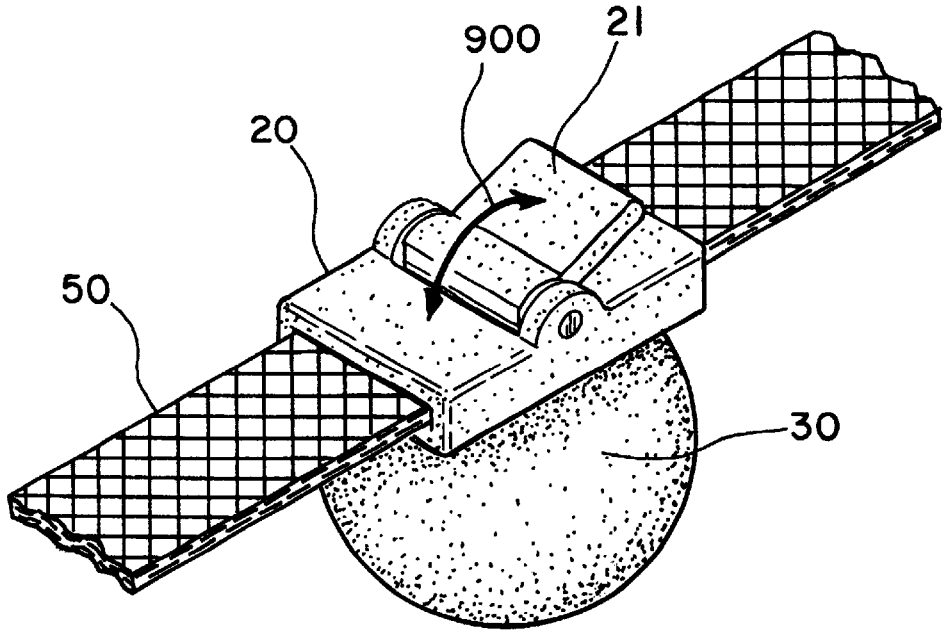
FIG. 9 is a variation of the locking mechanism of the present invention.

It is to be expressly understood that many different mechanical approaches can be utilized to couple 20 the weight 30 to the line 50, either in a permanent relationship or in the removable relationship as discussed above. The use of two half portions 22 and 24 hinged together as a lock is but one of many possible mechanical locking approaches. Furthermore, the use of a bolt 28 and a nut 29 is only one of a vast number of mechanical approaches for securing the lock 21. In another variation, where the line 50 is a nylon strap, the coupler 20 is rectangular in shape as shown in FIG. 9 and the lock 21 is a cammed-lever 21 that selectively engages and releases, in the direction of arrow 900 from the line 50. The present invention provides for any means for coupling 20 the weight 30 to the line 50 so as to slide along the line (or, in another embodiment, to release from the line) and then to lock the weight 30 at the selected region 100. While FIGS. 4A and 4B show a weight 30 that slides along line 50, it can be designed to be fully released from line 50. Likewise, while FIGS. 7A and 7B show a weight 30 then can be released from line 50, it can be designed to slide along line 50.

4. Weight of Line 50.

Winch lines 50 which are made from wire rope or cable are of many different diameters, lengths, and tensile strengths. There is an overall weight to the line 50 which is a function of its material, diameter and length. For example and in the case of wire ropes, the weight of the weight 30 can be one half the weight of the line 50 (e.g., weight 30 is 25 pounds for a 50 pound line). The greater the percentage the weight of the weight 30 is in comparison to the weight of the wire rope 50, the more likely the weight 30, upon line breakage, will drop 220 directly down towards earth. The less the percentage, the greater the movement of the weight 30, perhaps even in the direction 740, due to the whipping of the free end 200 of the line 50. Some users of the present invention may opt for greater safety by carrying a heavier weight 30 and other users may opt for less safety so that they can transport a lighter weight 30. The present invention, in one variation, uses a weight 30 in a range of about 20 percent to 150 percent of the weight of the wire rope 50. In this embodiment, for a 50 pound line, the weight of the weight 30 is in a range of about 10 to 75 pounds.

In the case of the line 50 being a nylon strap as shown in FIG. 9, the weight of the strap may only be a few pounds so the weight 30 can be any suitable weight.

5. Methods.

The safety method for a winch 40 is set forth above wherein the winch 40 has a line 50. The method includes coupling 20 a weight 40 to the line, locking 21 the weight 40 at a selected region 100 to the line 50 when the line 50 is extended from the winch 40. When the extended line suddenly releases the locked weight providing a pivot P for the released line about the selected region 100. The safety method further includes sliding the coupled weight along the line when the coupled weight is unlocked from the line. The weight has a weight between 20% and 150% of the weight of the line. The method further includes releasing the coupled weight from the line when the weight is not in use. The method further includes resting the weight on a ground surface when the weight is locked to the line.

The above disclosure sets forth a number of embodiments of the present invention. Those skilled in this art will however appreciate that other arrangements or embodiments, not precisely set forth, could be practiced under the teachings of the present invention and that the scope of this invention should only be limited by the scope of the following claims.

I claim:

1. A safety device for a winch having a winch line, said safety device comprising:

a weight coupled to said winch line, a lock on said weight, said lock locking said weight to said winch line at a selected region on the winch line when the winch line is extended from the winch and hooked under tension to an object, when said extended line suddenly releases said weight providing a pivot for the released line at said selected region, wherein the weight further comprises:

a coupler, a connector connecting said weight to said coupler, said lock located on said coupler.

2. The safety device of claim 1 wherein the weight is formed from metal material.

3. The safety device of claim 2 wherein the weight has a protective coating of material around the metal material.

4. The safety device of claim 1 wherein the weight is formed of rubber-like material.

5. The safety device of claim 1 wherein the weight has rounded edges.

6. The safety device of claim 1 wherein the weight is colored.

7. The safety device of claim 1 wherein the connector is of sufficient length for the locked weight to rest on a ground surface.

8. The safety device of claim 7 wherein the connector is a cable, said cable stored in a hollow portion of said weight not in use.

9. The safety device of claim 1 wherein outwardly extending shapes are formed of shock-absorbing material on an outer surface of the weight.

10. A safety device for a winch having a winch line, said safety device comprising:

a weight coupled to said winch line, a lock on said weight, said lock locking said weight to said winch line at a selected region on the winch line when the winch line is extended from the winch and hooked under tension to an object, when said extended line suddenly releases said weight providing a pivot for the released line at said selected region, wherein said weight slides along said winch line when said weight is unlocked from the winch line, said weight carried at an end of said winch line when said line is fully retracted into said winch.

11. A safety device for a winch having a winch line, said safety device comprising:

a weight coupled to said winch line, a lock on said weight, said lock locking said weight to said winch line at a selected region on the winch line when the winch line is extended from the winch and hooked under tension to an object, when said extended line suddenly releases said weight providing a pivot for the released line at said selected region, wherein said safety device releases from said winch line when said lock is unlocked from said winch line.

12. A safety method for a winch, the winch having a winch line, the method comprising:

coupling a weight to the winch line, locking the coupled weight at a selected region to the winch line when the winch line is extended from the winch, when the extended winch line suddenly releases the locked weight providing a pivot for the released winch line about the selected region, sliding the coupled weight along the winch line when the coupled weight is unlocked from the winch line.

13. The safety method of claim 12 wherein the weight has a weight between 20% and 150% of the weight of the winch line.

14. A safety method for a winch, the winch having a winch line, the method comprising:

coupling a weight to the winch line, locking the coupled weight at a selected region to the winch line when the winch line is extended from the winch, when the extended winch line suddenly releases the locked weight providing a pivot for the released winch line about the selected region, releasing the coupled weight from the winch line when the weight is not in use.

15. A safety method for a winch, the winch having a winch line, the method comprising:

coupling a weight to the winch line, locking the coupled weight at a selected region to the winch line when the winch line is extended from the winch, when the extended winch line suddenly releases the locked weight providing a pivot for the released winch line about the selected region, resting the weight on a ground surface when the coupled weight is locked.

* * * * *